US006196906B1

(12) United States Patent
Hakomori

(10) Patent No.: US 6,196,906 B1
(45) Date of Patent: Mar. 6, 2001

(54) SURFACE POLISHING APPARATUS AND METHOD OF TAKING OUT WORKPIECE

(76) Inventor: Shunji Hakomori, 2647, Hayakawa, Ayase-shi (JP)

( * ) Notice: Subject to any disclaimer, the term of this patent is extended or adjusted under 35 U.S.C. 154(b) by 0 days.

(21) Appl. No.: 09/298,029

(22) Filed: Apr. 22, 1999

(30) Foreign Application Priority Data

May 12, 1998 (JP) ..... 10-129240

(51) Int. Cl.[7] ..... B24B 47/02
(52) U.S. Cl. ..... 451/339; 451/397
(58) Field of Search ..... 451/41, 331, 332, 451/339, 262, 270, 285, 287, 288, 364, 365, 397, 398, 388, 289

(56) References Cited

U.S. PATENT DOCUMENTS 4,502,252 * 3/1985 Iwabuchi ..... 451/339
5,333,413 * 8/1994 Hashimoto ..... 451/339
5,429,544 * 7/1995 Hasegawa et al. ..... 451/388
5,443,416 * 8/1995 Volodarsky et al. ..... 451/388
5,947,802 * 9/1999 Zhang et al. ..... 451/339

* cited by examiner

*Primary Examiner*—Derris H. Banks
(74) *Attorney, Agent, or Firm*—Snell & Wilmer, L.L.P.

(57) ABSTRACT

A workpiece can be simply taken out from a surface plate by a small force without being damaged even though the workpiece is stuck to the workpiece through the surface tension of polishing liquid intervening between the workpiece and the surface plate. By using a takeout device comprising a chucking means for chucking the workpiece and a posture control mechanism for changing the posture of the chuck means, the workpiece horizontally set on the surface plate is chucked by the chuck means in its horizontal posture, and then the chuck means 15 is inclined by the posture control mechanism so as to lift up one end part of the workpiece W in order to separate the workpiece from the surface plate. Thereafter the workpiece can be lifted up in its entirety so as to be taken out from the surface plate.

38 Claims, 4 Drawing Sheets

SURFACE POLISHING APPARATUS AND METHOD OF TAKING OUT WORKPIECE

FIELD OF THE INVENTION

The present invention relates to measures for taking out a workpiece from a surface plate after completion of polishing in a surface polishing device for polishing a disc-like workpiece such as a semiconductor wafer or a magnetic disc substrate.

RELATED ART

A surface polishing apparatus such as a lapping machine or a polishing machine, incorporates a sun gear, an internal gear and upper and lower surface plates which are concentrically arranged, and a carry meshed with both gears so as to carries out planetary motion. With this arrangement, opposite surfaces of a workpiece W held by the carrier by means of the surface plates are polished while polishing liquid is fed thereto.

In such a polishing apparatus, the workpiece after completion of polishing is taken out by, for example, a vacuum type chuck means from a holding hole for the workpiece in the carrier. Since washing liquid is present between the workpiece and the outer surfaces of the surface plates, the workpiece sticks to the outer surfaces of the surface plates due to the surface tension of the polishing liquid, and accordingly, a large force is required for taking out the workpiece or it is likely to cause damage such as breakage to the workpiece. In particular, such damage is liable to occur to a thin workpiece such as a semiconductor wafer.

SUMMARY OF THE INVENTION

An object of the present invention is to enable a workpiece to be simply and surely taken out from a surface plate even though polishing liquid is present therebetween.

To that end according to the present invention, there is provided a method of taking out a workpiece, comprising the steps of chucking a workpiece horizontally set on a surface plate by means of a chuck means, lifting up one end of the workpiece by inclining the chuck mechanism with the use of a posture control mechanism so as to separate the workpiece from the surface plate, and thereafter, lifting the workpiece in its entirety so as to take out the workpiece from the surface plate.

In the above-mentioned method, the above-mentioned workpiece may be chucked mechanically at its outer periphery by a plurality of openable pawl members or under vacuum.

Further, in order to carry out the above-mentioned takeout method, according to the present invention, there is provided a takeout apparatus comprising a chuck means for chucking a workpiece, and a posture control device for controlling the posture of the workpiece. The chuck means has a plurality of pawl members which can be opened and closed by a first actuator attached to a base member, and with which a workpiece is chucked at its outer periphery. Further, the above-mentioned posture control mechanism has a support part provided at the distal end of a takeout arm, for supporting the base member which is therefore tiltable, and a second actuator for controlling the posture of the base member between a horizontal condition and an inclined condition, and accordingly, the chuck means is inclined by the second actuator through the intermediary of the base member. The above-mentioned carrier has a plurality of cutouts at the peripheral edge of the workpiece holding hole, through which the pawl members of the chuck means are inserted and engaged with the outer periphery of the workpiece.

In a surface polishing apparatus according to the present invention, instead of the above-mentioned chuck means for chucking the outer periphery of the workpiece by means of the pawl members, a vacuum chuck means comprising a chuck head having suction holes connected to a vacuum pump, and a base member for supporting the chuck head can be used.

In a specific form of the present invention, the base member of the chuck means is suspended by the support member at a position where the base member is gravitationally unbalanced, and accordingly, the chuck means is inclined by its dead weight when the takeout arm is lifted. Further, it is returned to its horizontal posture by means of the second actuator.

According to the present invention having the above-mentioned arrangement, the workpiece is not lifted up being held horizontally, but it is lifted up at first by its one end so as to be separated from the surface plate, and thereafter, the workpiece is lifted up its entirety so as to be taken out. Thus, even though the workpiece is stuck to the outer surface of the surface plate by the polishing liquid which is present between the workpiece and the surface plate, the sticking can be simply eliminated, and accordingly, the workpiece can surely be taken out by a small force. Thereby it is possible to safely take out the workpiece with no damage even though the workpiece such as a semiconductor wafer has a thin thickness and a large diameter.

BRIEF DESCRIPTION OF THE DRAWINGS

The present invention is illustrated by way of example and not limitation in the accompanying figures, in which like references indicate similar elements, and in which.

Skilled artisans will appreciate the elements in the figures are illustrated for simplicity and clarity and have not necessarily been drawn to scale. For example, the dimensions of some of the elements in the figures may be exaggerated relative to other elements to help to improve understanding of embodiments of the present invention.

DESCRIPTION OF PREFERRED EMBODIMENTS OF THE INVENTION

Figure 1:
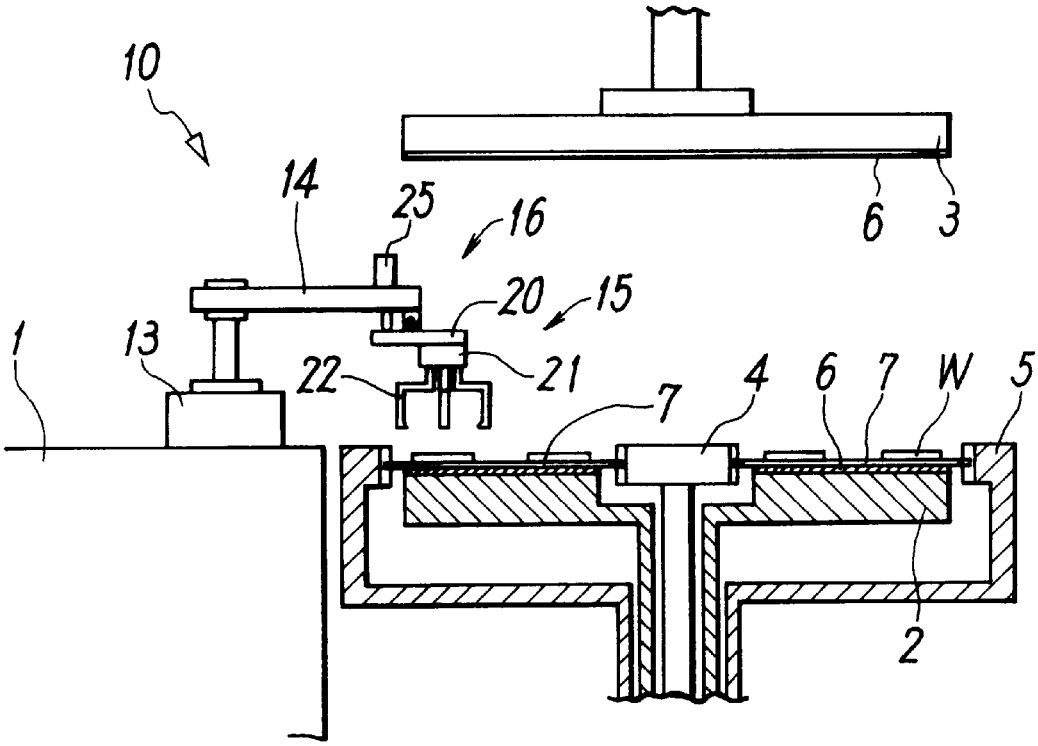
FIG. 1 illustrates a side view of an exemplary embodiment of a surface polishing apparatus of the present invention.

Referring to FIG. 1 which shows an example of a surface polishing apparatus according to the present invention, there are shown a machine frame 1, a lower surface plate 2, a rotatable upper surface plate 3 elevatably supported by means of an air cylinder which is not shown, above the lower surface plate 2, a sun gear 4 rotatably arranged in the center part of the lower surface plate 2, and an internal gear 5 rotatably arranged at a position where it surrounds the lower surface plate 2, both surface plates 2, 3 and both gears 4, 5 being coupled to a motor which is not shown through a transmission mechanism, and are rotated in required directions at required speeds.

Figure 2:
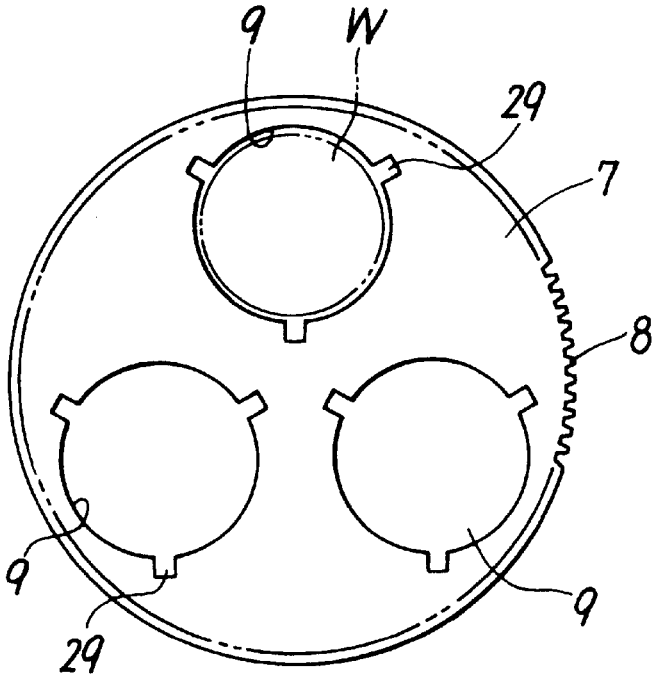
FIG. 2 illustrates a top view of an exemplary embodiment of a surface polishing apparatus of the present invention.
Figure 3:
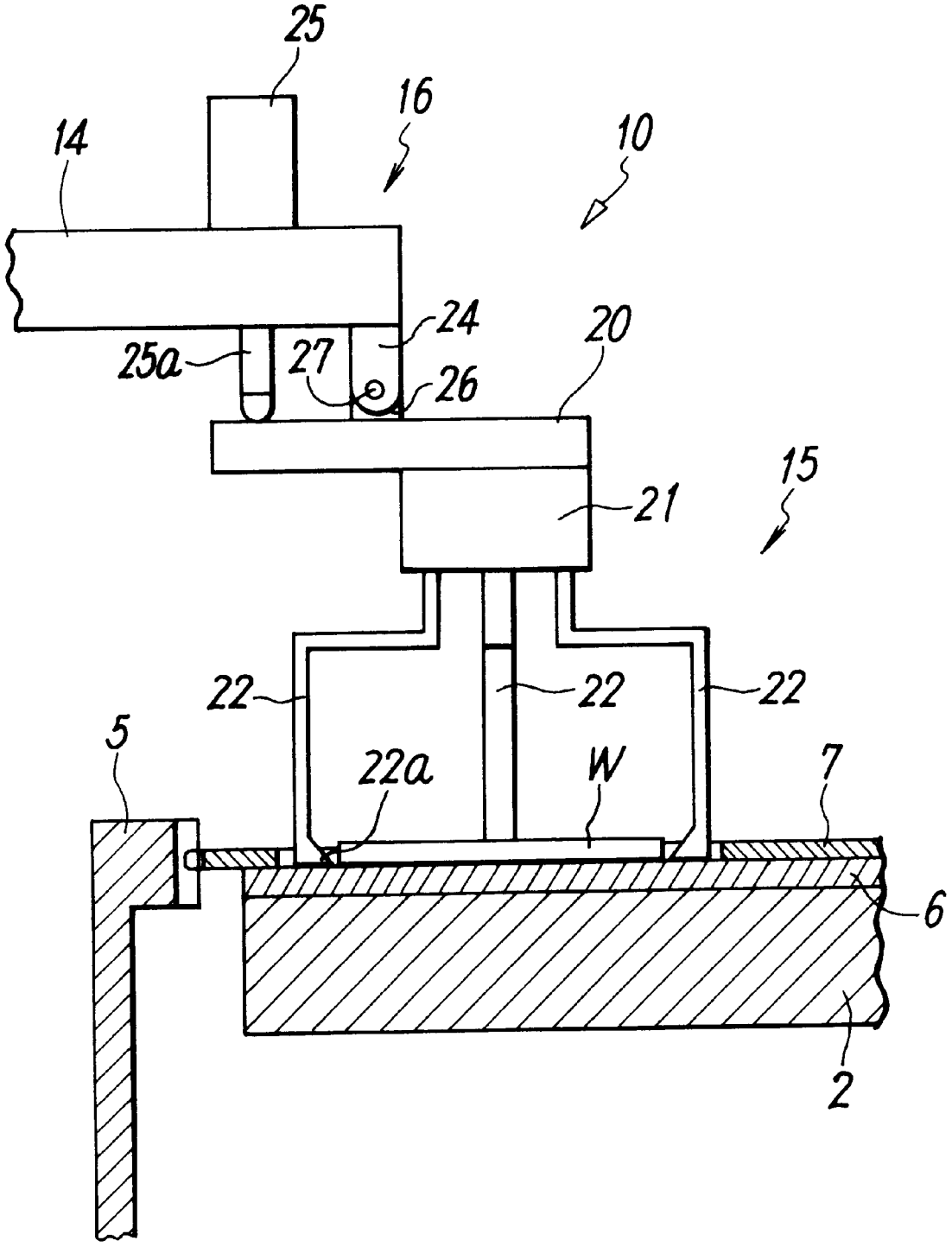
FIG. 3 illustrates a side view of an exemplary embodiment of a takeout device of the present invention prior to removing a workpiece from a workpiece carrier.

On the above-mentioned lower surface plate 2, a plurality of carriers 7 for holding workpieces W to be polished are arranged at equal intervals, and as clearly understood from FIGS. 2 and 3, each of the carriers 7 has a gear part at its outer periphery which is meshed with both gears 4, 5 so that it rotates at its own axis and revolves around the sun gear 4 so as to carry out the so-called planetary motion when the gears 4, 5 are rotated. Further, each carrier 7 is formed therein one or a plurality of circular workpiece holding holes 9 for holding the disc-like workpiece W, and accordingly, the workpiece 7 held in the workpiece holding hole 9 is polished by means of the upper and lower surface plates 2, 3. The upper and lower surfaces plates are stuck thereto with polishing pads 6.

A takeout device 10 for taking out the workpiece after completion of polishing from the workpiece holding hole 9 in the carrier 7 is provided at a position adjacent to the lower surface plate 2 in the machine frame 1. This takeout device 10 has a chuck means 15 for chucking the workpiece W and a posture control mechanism 16 for controlling the posture of the chuck means 15, at a distal end of a takeout arm 14 which is supported by a support mechanism 13 so as to be elevatable and rotatable.

As clearly understood from FIG. 3, the chuck means 15 has a first actuator 21 attached to the base member 20 at a position near to the distal end of the latter, and a plurality (three in the example shown in the figure) of pawl members 22 which can be opened and closed by means of the first actuator 21 and by which the workpiece W is chucked at its outer periphery and is lifted up. The first actuator 21 may be constituted by an air cylinder.

Meanwhile, the posture control mechanism 16 has a support member 24 provided at the distal end of the takeout arm 14 and tiltably supporting the base member 20, and a second actuator 25 for controlling the posture of the base member 20 in order to change the posture of the base member 20.

The above-mentioned chuck means 15 is suspended by a support member 24 at a position where it is gravitationally unbalanced above the base member 20, and accordingly, the chuck means 15 is inclined by its dead weight. That is, a coupling member 26 is provided at a position on the base member 20, which is far from the attaching position of the first actuator 21 but near to the proximal end of the base member 20, and the coupling member 26 is rotatably coupled to the support member 24 through the intermediary of a shaft 27. Thus, when the takeout arm 14 ascends, the base member 20 is inclined, the distal end side thereof to which the first actuator 21 is attached, is downward directed.

Further, the second actuator 25 consists of an air cylinder, and a rod 25*a* extending downward from the takeout arm 14 abut the base member 20 at a position which is far from the suspending position of the support member 24 but near to the proximal end of the base member 20, and accordingly, through the extension and retraction of the rod 25*a* the posture (inclination) of the base member 20 is changed.

The lower end parts 22*a* of each of the pawl members 22 are sharpened inward, and these lower end parts 22*a* compress the polishing pad 6 more or less and enter underneath the workpiece W so as to engage the workpiece W.

It is noted that FIG. 1 shows such a condition that the takeout device 10 has been moved to the takeout position for the workpiece W. It goes without saying that this takeout device 10 should be turned to a position where the takeout arm 14 does not hinder the operation of the upper surface plate 3 when upper surface plate 3 is lowered for polishing.

Meanwhile, a plurality of cutouts 29 for inserting the pawl members 22 in the takeout device 10 are formed in the peripheral edge of each of the workpiece holding holes in the carrier 7, as shown in FIG. 2, and accordingly, the pawl members 22 chuck the outer periphery of the workpiece W through the cutouts 29. The cutouts 29 are formed having the same relationship with respect to the associated workpiece holding holes 9.

Takeout device 10 is presented with each of the carriers 7, and when the workpieces W are to be taken out, workpieces W which have been turned to the takeout position are taken out from the workpiece holding holes 9, one by one, while the carriers 7 are intermittently rotated by predetermined angle intervals around their axes by means of the sun gear 4 and the internal gear 5, at their own positions.

In the surface polishing apparatus having the above-mentioned arrangement, a workpiece to be polished, held in the workpiece holding hole 9 of the carrier 7 is polished in a way similar to that carried out by a conventional surface polishing apparatus. That is, when the workpiece, W to be polished is fed into the workpiece holding hole 9 of the carrier 7 by a suitable loading device which is not shown, the upper surface plate 3 is lowered from the position shown in FIG. 1, and both gears 4, 5 and both surface plates 2, 3 are rotated, and accordingly, both upper and lower surfaces of the workpiece W held on the carrier 7 which carries out planetary motion around the sun gear are polished by means of the upper and lower surface plates 2, 3.

After completion of the polishing, both gears 4, 5 and both surface plates 2, 3 come to a stop, and as shown in FIG. 1, the upper surface plate 3 is raised to its standby position, and the takeout device 10 is turned to the takeout position so as to take out the polished workpieces W from the associated carrier 7. At this time, the carriers 7 are intermittently rotated at predetermined angular intervals around their axes at their positions by controlling the rotational speeds and the rotating directions of the sun gear and the internal gear 5, and accordingly, the workpieces W which have been turned to the takeout position are taken out one by one from the workpiece holding holes 9.

The takeout of the above-mentioned workpieces W can be made as follows:

At first, the rod 25*a* of the second actuator 25 is extended so as to press the proximal end part of the base 20 so that the pawl members 22 are inserted in the cutouts 29 while the chuck means 15 is horizontally held, and the distal end parts 22*a* of the pawl members 22 enter underneath the workpiece W, and are engaged to the outer periphery of the workpiece W.

Figure 4:
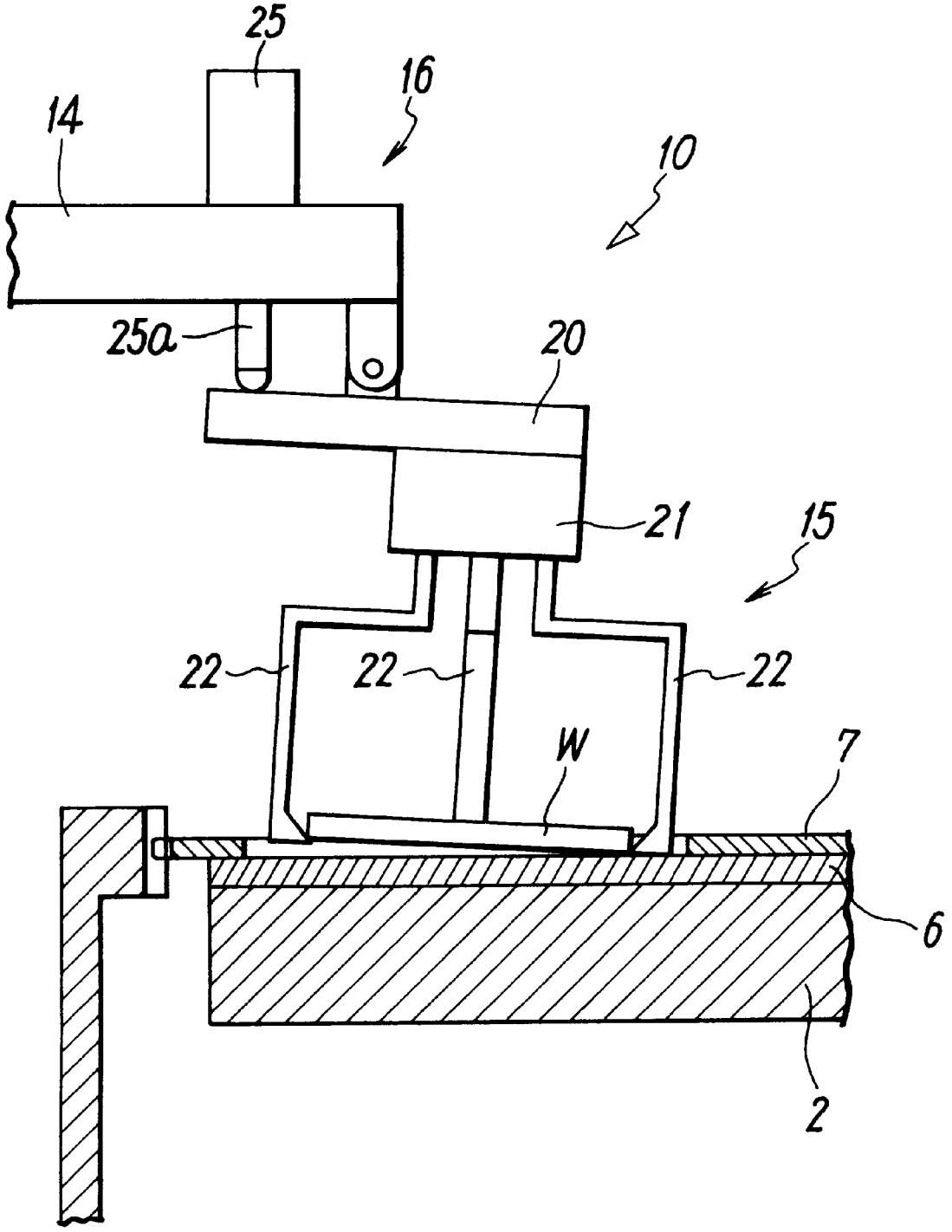
FIG. 4 illustrates a side view of an exemplary embodiment of the takeout device of FIG. 3 upon removing a workpiece from a workpiece carrier.

Next, as shown in FIG. 4, when the rod 25*a* of the second actuator 25 is slightly retracted while the takeout arm 14 is raised, the base member 20, and accordingly, also the chuck means 15 are raised while being inclined, the workpiece W is first lifted up at its one end thereof so as to be separated from the lower surface plate 3, and thereafter, the workpiece W is lifted up in its entirety. At this time, the chuck means 15 may be soon raised upward to a predetermined height while it is still inclined, and then the posture of the chuck means 15 is controlled by extending the rod 25*a* of the second actuator 25 so as to be set horizontally. However, the posture of the chuck means may be controlled so as to be horizontally set just after the one end part of the workpiece W is separated from the lower surface plate 3.

Thus, since the workpiece W is first lifted up at its one end without being lifted up in a horizontal posture, so as to be separated from the lower surface plate 3, and thereafter, the workpiece W is lifted up in its entirety so as to be taken out, even though the workpiece W is stuck to the outer surface of the surface plate by the polishing liquid intervening between the workpiece and the surface plate, the sticking can be soon eliminated so that the workpiece W can be surely taken out by a small force. Thereby it is possible to take out the workpiece without damaging the same even if the workpiece W has a thin thickness and a large diameter, as in this case of a semiconductor wafer.

In the embodiment as shown, the takeout devices 10 in the number equal to that of the carriers 7 are provided at positions corresponding to the carriers 7. Alternatively, only one takeout device 10 may be located at a position while the carriers 7 are moved one by one to the position in order to take out the workpieces W from the carriers 7.

Further, although it has been explained that the carrier 7 has three workpiece holding holes, it is of course possible to form one, two or not smaller than 4 of the workpiece holding holes.

Figure 5:
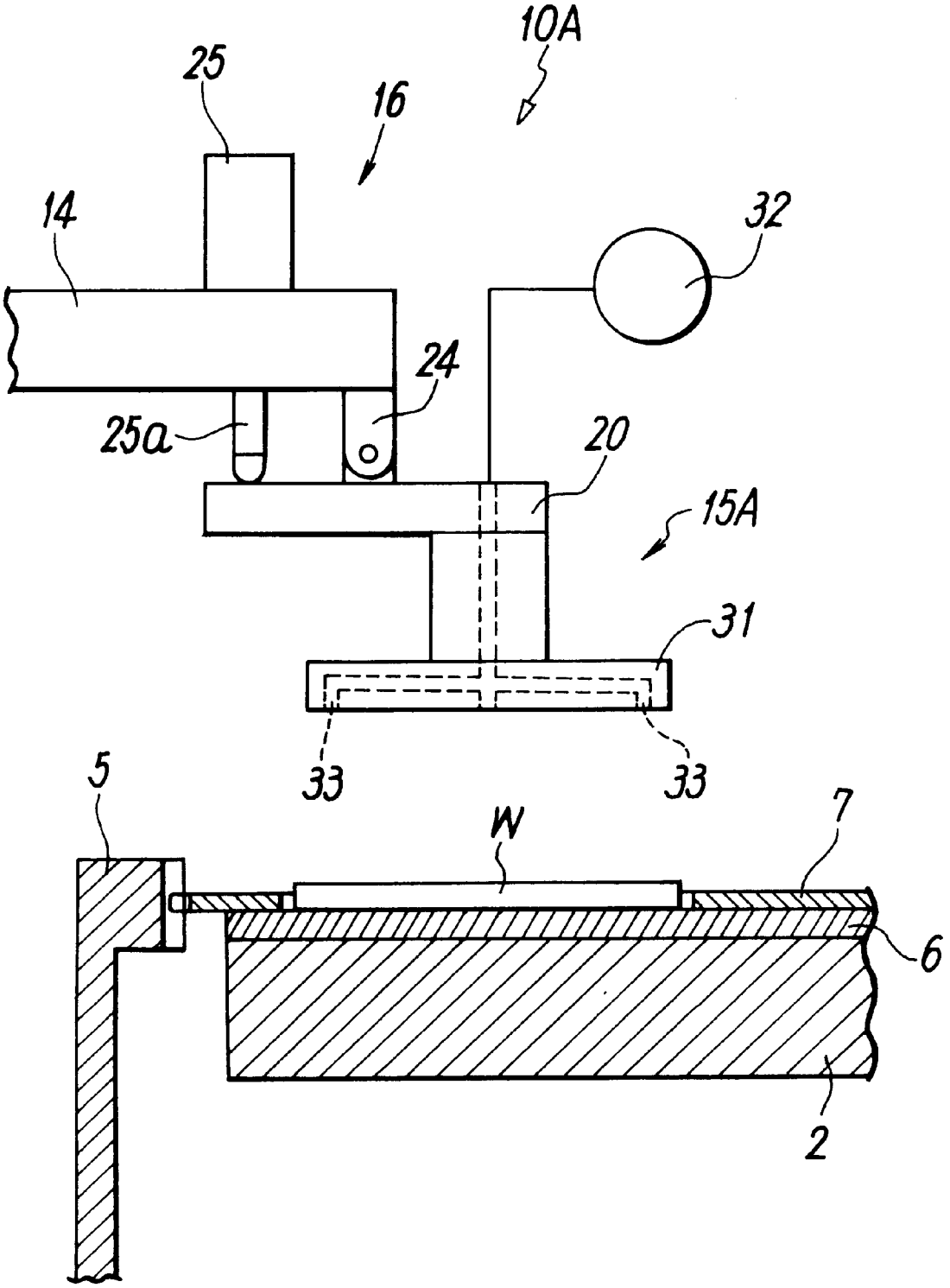
FIG. 5 illustrates a side view of another exemplary embodiment of a takeout device of the present invention.

FIG. 5 shows a second embodiment of the takeout device according to the present invention present invention, which is the same as that of the first embodiment, except that a different chuck means is used. That is, in the first embodiment, the chuck means 15 is composed of a plurality of pawl members 22 for chucking the outer periphery of the workpiece W. In this second embodiment, the takeout device 10A comprises the chuck means 15A which has a chuck head 31 having suction holes 33 communicated with a vacuum pump 32, and attached to the base member 20. The other arrangement and the operation of this second embodiment is the same at those of the first embodiment.

In the embodiments as mentioned above, the chuck means 15, 15A, are suspended at a position where it is gravitationally unbalanced on the base member 20, and accordingly, they are inclined by their dead weight. However the chuck means may be suspended at a position where it is gravitationally balanced, and the posture thereof may be changed by an actuator such as an air cylinder.

Thus, according to the present invention, since the workpiece is taken out in its entirety after one end thereof is at first lifted up so as to be separated from the surface plate, even though the workpiece is stuck to the outer surface of the surface plate by polishing liquid intervening between the workpiece and the surface plate, the sticking can be simply eliminated so that the workpiece can be taken out by a small force. Thus, even though the workpiece has a thin thickness and a large diameter, as does a semiconductor wafer, the workpiece can be safely taken out without being damage.

What is claimed is:

1. A method of taking out a workpiece by using a takeout device including a chuck means for chucking a disc-like workpiece, and a posture control mechanism for controlling the posture of the chuck means between a horizontal posture and an inclined posture, comprising the steps of chucking the workpiece horizontally set on a surface plate by a chuck means set in the horizontal posture, inclining the chuck means by said posture control mechanism, for lifting up one end of the workpiece so as to separate the same from the surface plate and thereafter, lifting up the workpiece.

2. A method as set forth in claim 1, wherein said workpiece comprises an outer periphery and said workpiece is chucked at said outer periphery by a plurality of openable pawl members.

3. A method as set forth in claim 1, wherein said workpiece is vacuum-chucked by said chuck means having suction holes communicated with a vacuum pump.

4. A surface polishing apparatus comprising a sun gear centrally located, an internal gear located surrounding the sun gear, a carrier meshed with said both gears so as to carry out planetary motion around the sun gear, upper and lower surface plates holding therebetween a disk-like workpiece held in a workpiece holding hole formed in the carrier, for polishing the workpiece, and a takeout device for taking out the workpiece from the workpiece holding hole in the carrier, said takeout device comprising a chuck means for chucking the workpiece, and a posture control mechanism for controlling the posture of the chuck means between a horizontal posture and an inclined posture, said chuck means comprising a plurality of pawl means which can be opened and closed by a first actuator attached to a base member, for chucking an outer periphery of the workpiece, said posture control mechanism comprising a support member provided at a distal end of a takeout arm, for tiltably supporting the base member, and a second actuator for controlling a posture of the base member between a horizontal posture and an inclined posture; and said carrier having a plurality of cutouts formed at an outer periphery of the workpiece holding hole, for inserting the pawl members of the chuck means so as to engage the same to the outer periphery of the workpiece.

5. A surface polishing apparatus as set forth in claim 4, wherein the base member of said chuck means is suspended by a support member at a position where said base member is gravitationally unbalanced so that the chuck means is inclined by the dead weight of said chuck means when the takeout arm is raised, and is returned to a horizontal posture by actuating said second actuator.

6. A surface polishing apparatus comprising a sun gear centrally located, an internal gear located surrounding the sun gear, a carrier meshed with said both gears so as to carry out planetary motion around the sun gear, upper and lower surface plates holding therebetween a disk-like workpiece held in a workpiece holding hole formed in the carrier, for polishing the workpiece, and a takeout device for taking out the workpiece from the workpiece holding hole in the carrier after completion of the polishing, said takeout device comprising a chuck means for chucking the workpiece, and a posture control mechanism for controlling the posture of the chuck means between a horizontal posture and an inclined posture, said chuck means comprising a chuck head having suction holes communicated with a vacuum pump, and a base member for supporting the chuck head, said posture control mechanism comprising a support member provided at a distal end of a takeout arm, for tiltably supporting a base member, and an actuator for controlling the posture of the base member between a horizontal posture and an inclined posture.

7. A surface polishing apparatus as set forth in claim 6, wherein the base member of said chuck means is suspended by a support member at a position where said base member is gravitationally unbalanced so that the chuck means is inclined by the dead weight of said chuck means when the takeout arm is raised, and said chuck means is returned to a horizontal posture by actuating said actuator.

8. A workpiece removal device for use with a surface polishing apparatus, wherein said surface polishing apparatus comprises a surface plate for polishing a workpiece and at least one carrier disposed adjacent said surface plate and having a hole formed therein configured to hold a workpiece, wherein said workpiece removal device comprises:

a chucking mechanism for retrieving said workpiece from said carrier;

a posture control mechanism for controlling the position of said chucking mechanism between a horizontal posture and an inclined posture; and a takeout arm operatively connected to said chucking mechanism and said posture control mechanism and configured to move said workpiece removal device between a workpiece removal position and a standby position;

wherein, when said takeout arm is in said workpiece removal position, said chucking mechanism contacts said workpiece in a horizontal posture and said posture control mechanism positions said chucking mechanism to an inclined posture for lifting an end of said workpiece to separate said workpiece from said surface plate to facilitate retrieving said workpiece from said carrier.

9. The workpiece removal device of claim 8, wherein said surface polishing apparatus further comprises a vacuum pump and said chucking mechanism comprises:

a chuck head having at least one suction hole operatively connected to said vacuum pump to effect a vacuum within said suction hole to retrieve said workpiece from said carrier; and a base member connected to said chuck head for supporting said chuck head.

10. The workpiece removal device of claim 9 wherein said takeout arm comprises a distal end, and wherein said posture control mechanism comprises:

a support member connected to said distal end of said takeout arm and configured to tiltably support said base member; and an actuator for controlling the respective positions of said base member and said chuck head between said horizontal posture and said inclined posture.

11. The workpiece removal device of claim 10 wherein said base member is connected to said support member at a position where said base member is gravitationally unbalanced so that said chuck head is positioned at said inclined posture when said takeout arm is raised above said surface plate and said chuck head is positioned at said horizontal posture by activation of said actuator.

12. The workpiece removal device of claim 8, wherein said chucking mechanism comprises a plurality of pawl members configured to grasp said workpiece and to remove said workpiece from said carrier.

13. The workpiece removal device of claim 12, further comprising a first actuator configured to move said plurality of pawl members such that each of said plurality of pawl members grasps said workpiece.

14. The workpiece removal device of claim 13, wherein said carrier further comprises a plurality of cutouts formed at the outer periphery of said hole wherein each of said plurality of cutouts is configured to receive one of said plurality of pawl members.

15. The workpiece removal device of claim 14, further comprising a base member configured to support said plurality of pawl members.

16. The workpiece removal device of claim 15, wherein said posture control mechanism comprises:

a support member connected to said takeout arm and configured to tiltably support said base member; and a second actuator configured to control the respective positions of said base member and said chucking mechanism between said horizontal posture and said inclined posture.

17. The workpiece removal device of claim 16, wherein said chucking mechanism is positioned at said inclined posture when said takeout arm is raised above said surface plate and said horizontal posture by activation of said second actuator.

18. A surface polishing apparatus comprising:

a sun gear;

an internal gear concentrically surrounding said sun gear;

a plurality of carriers each having a central axis and each having a hole formed therein configured to hold a workpiece having an upper surface and a lower surface, wherein each of said plurality of carriers is configured to engage said sun gear and said internal gear and to revolve around said sun gear while rotating around said central axis;

an upper surface plate disposed adjacent to said upper surface of said workpiece and configured to polish said upper surface of said workpiece;

a lower surface plate disposed adjacent to said lower surface of said workpiece and configured to polish said lower surface of said work; and a workpiece removal device comprising a chucking mechanism for removing said workpiece from each of said plurality of carriers, said workpiece removal device further comprising a posture control mechanism for controlling the posture of the chucking mechanism between a horizontal posture and an inclined posture.

19. The surface polishing apparatus of claim 18, wherein said workpiece removal device further comprises a takeout arm operatively connected to said chucking mechanism and said posture control mechanism, said takeout arm being configured to move said workpiece removal device between a workpiece removal position and a standby position.

20. The surface polishing apparatus of claim 19, further comprising a vacuum pump and wherein said chucking mechanism comprises:

a chuck head having at least one suction hole operatively connected to said vacuum pump to effect a vacuum within said suction hole to retrieve said workpiece from said carrier; and a base member connected to said chuck head for supporting said chuck head;

wherein, upon removal of said workpiece from said carrier, said takeout arm is in said workpiece removal position, said chuck head contacts said workpiece in a horizontal posture and said posture control mechanism positions said chucking mechanism to an inclined posture for lifting an end of said workpiece to separate said workpiece from said lower surface plate and retrieve said workpiece from said carrier.

21. The surface polishing apparatus of claim 20 wherein said takeout arm comprises a distal end, and wherein said posture control mechanism comprises:

a support member connected to said distal end of said takeout arm and configured to tiltably support said base member; and an actuator for controlling the respective positions of said base member and said chuck head between said horizontal posture and said inclined posture.

22. The surface polishing apparatus of claim 21 wherein said base member is connected to said support member at a position where said base member is gravitationally unbalanced so that said chuck head is positioned at said inclined posture when said takeout arm is raised above said surface plate and said chuck head is positioned at said horizontal posture by activation of said actuator.

23. The surface polishing apparatus of claim 19, wherein said chucking mechanism comprises a plurality of pawl members configured to grasp said workpiece and to remove said workpiece from said carrier.

24. The surface polishing apparatus of claim 23, further comprising a first actuator configured to move said plurality of pawl members such that each of said plurality of pawl members grasps said workpiece.

25. The surface polishing apparatus of claim 24, wherein each of said plurality of carriers further comprises a plurality of cutouts formed at the outer periphery of said hole wherein each of said plurality of cutouts is configured to receive one of said plurality of pawl members.

26. The surface polishing apparatus of claim 25, further comprising a base member configured to support said plurality of pawl members.

27. The surface polishing apparatus of claim 26, wherein said posture control mechanism comprises:

a support member connected to said takeout arm and configured to tiltably support said base member; and a second actuator configured to control the respective positions of said base member and said chucking mechanism between said horizontal posture and said inclined posture, wherein, upon removal of said workpiece from said carrier, said takeout arm is in said workpiece removal position, said chucking mechanism contacts said workpiece in a horizontal posture and said posture control mechanism positions said chucking mechanism to an inclined posture for lifting an end of said workpiece to separate said workpiece from said lower surface plate and retrieve said workpiece from said carrier.

28. The surface polishing apparatus of claim 27, wherein said chucking mechanism is positioned at said inclined posture when said takeout arm is raised above said surface plate and at said horizontal posture by activation of said second actuator.

29. A method of removing a workpiece from a surface polishing apparatus using a workpiece removal device, wherein said surface polishing apparatus comprises a surface plate for polishing a workpiece and at least one carrier disposed adjacent said surface plate and having a hole formed therein configured to hold a workpiece and wherein said workpiece removal devices comprises:

a chucking mechanism for retrieving said workpiece from said carrier;

a posture control mechanism for controlling a position of the chucking mechanism between a horizontal posture and an inclined posture; and a takeout arm operatively connected to said chucking mechanism and said posture control mechanism and configured to move said workpiece removal device between a workpiece removal position and a standby position;

said method comprising the following:

moving said takeout arm to said workpiece removal position, causing said chucking mechanism to contact said workpiece in a horizontal posture and causing said posture control mechanism to position said chucking mechanism to an inclined posture for lifting an end of said workpiece to separate said workpiece from said surface plate to facilitate retrieving said workpiece from said carrier.

30. The method of claim 29, wherein said surface polishing apparatus further comprises a vacuum pump and said chucking mechanism comprises:

a chuck head having at least one suction hole operatively connected to said vacuum pump to effect a vacuum within said suction hole to retrieve said workpiece from said carrier; and a base member connected to said chuck head for supporting said chuck head.

31. The method of claim 30 wherein said takeout arm comprises a distal end, and wherein said posture control mechanism comprises:

a support member connected to said distal end of said takeout arm and configured to tiltably support said base member, and an actuator for controlling the respective positions of said base member and said chuck head between said horizontal posture and said inclined posture.

32. The method of claim 31 wherein said base member is connected to said support member at a position where said base member is gravitationally unbalanced so that said chuck head is positioned at said inclined posture when said takeout arm is raised above said surface plate after retrieval of said workpiece and said chuck head is subsequently positioned at said horizontal posture by activation of said actuator.

33. The method of claim 29, wherein said chucking mechanism comprises a plurality of pawl members configured to grasp said workpiece and to remove said workpiece from said carrier.

34. The method of claim 33, wherein said surface polishing apparatus further comprises a base member configured to support said plurality of pawl members.

35. The method of claim 34, wherein said surface polishing apparatus further comprises a first actuator configured to move said plurality of pawl members such that each of said plurality of pawl members grasps said workpiece.

36. The method of claim 35, wherein said carrier further comprises a plurality of cutouts formed at the outer periphery of said hole wherein each of said plurality of cutouts is configured to receive one of said plurality of pawl members.

37. The method of claim 36, wherein said posture control mechanism comprises:

a support member connected to said takeout arm and configured to tiltably support said base member; and a second actuator configured to control the respective positions of said base member and said chucking mechanism between said horizontal posture and said inclined posture.

38. The method of claim 37, further comprising: positioning said chucking mechanism at said inclined posture when said takeout arm is raised above said surface plate and positioning said chucking mechanism at said horizontal posture by activation of said second actuator.

* * * * *